US009140076B2

(12) United States Patent
Mahoney et al.

(10) Patent No.: US 9,140,076 B2
(45) Date of Patent: Sep. 22, 2015

(54) TORQUE TRACK SYSTEM AND METHOD

(75) Inventors: Nathan James Mahoney, Red Deer, CA (US); Martin Harthoorn, Calgary (CA)

(73) Assignee: TESCO CORPORATION, Houston, TX (US)

( * ) Notice: Subject to any disclaimer, the term of this patent is extended or adjusted under 35 U.S.C. 154(b) by 956 days.

(21) Appl. No.: 13/316,019

(22) Filed: Dec. 9, 2011

(65) Prior Publication Data

US 2013/0145723 A1 Jun. 13, 2013

(51) Int. Cl.

| | |
|---|---|
| ***E21B 15/00*** | (2006.01) |
| ***E21B 3/02*** | (2006.01) |
| ***E21B 19/16*** | (2006.01) |
| ***E21B 21/02*** | (2006.01) |

(52) U.S. Cl.

CPC . *E21B 15/00* (2013.01); *E21B 3/02* (2013.01); *E21B 19/16* (2013.01); *E21B 21/02* (2013.01)

(58) Field of Classification Search

None

See application file for complete search history.

(56) References Cited

U.S. PATENT DOCUMENTS

| | | | | | |
|---|---|---|---|---|---|
| 4,021,978 | A | * | 5/1977 | Busse et al. | 52/118 |
| 5,092,411 | A | * | 3/1992 | Hausherr et al. | 175/162 |
| 5,107,940 | A | * | 4/1992 | Berry | 175/85 |
| 5,381,867 | A | | 1/1995 | Berry | |

OTHER PUBLICATIONS

International Search Report and Written Opinion for International Application No. PCT/US2012/066848 mailed on Oct. 2, 2013.

* cited by examiner

*Primary Examiner* — Jennifer H Gay
*Assistant Examiner* — Caroline Butcher
(74) *Attorney, Agent, or Firm* — Fletcher Yoder, P.C.

(57) ABSTRACT

A top drive torque track system includes a first elongate track with a male end. The male end includes a pin housing and a movable locking pin capable of being biased by a biasing member to extend out of the pin housing and to extend laterally from the male end. The torque track system includes a second elongate track having a female end configured to mate with the male end. The female end has a locking socket extending laterally within the female end. The locking socket is configured to receive the movable locking pin. The movable locking pin is configured to engage the locking socket to attach the first elongate track to the second elongate track when the male end of the first elongate track is inserted into the female end of the second elongate track.

19 Claims, 4 Drawing Sheets

TORQUE TRACK SYSTEM AND METHOD

BACKGROUND

The present disclosure relates generally to the field of drilling and processing of wells, and, more particularly, to a torque track system and method for assembling the torque track system.

In conventional oil and gas operations, a well is typically drilled to a desired depth with a drill string, which includes drillpipe, drill collars and a bottom hole drilling assembly. The drill string may be turned by a rotary table and kelly assembly or by a top drive. A top drive typically includes a quill, which is a short length of pipe that couples with the upper end of the drill string, and one or more motors configured to turn the quill. The top drive is typically suspended from a traveling block above the rig floor so that it may be raised and lowered throughout drilling operations.

The top drive is attached to a torque track system that extends from a bottom portion to a top portion of the derrick. The torque track system guides the top drive as it moves between the bottom and the top of the derrick, restrains the top drive from lateral movement, and transfers torsional loads from a drilling operation to the derrick. Assembling and disassembling a torque track system may present various challenges. For example, elongate track sections are assembled to form the torque track system. During assembly multiple track sections are connected to form the torque track system. Conversely, during disassembly the multiple track sections are disconnected. In certain configurations, the elongate track sections may be held together using pins or bolts. In such configurations, two elongate track sections may be placed together and one or more pins may be driven through apertures in the track sections to hold the sections together. A technician that drives the pins into the track sections, or removes the pins from the track sections, may be suspended in the air along various vertical positions of the drilling rig to drive or remove the pins. Further, the technician may access equipment while assembling or disassembling the torque track system. For example, the technician may access pins for insertion into the track sections, and various tools for driving and removing the pins. As may be appreciated, assembling or disassembling a torque track system in such a manner may be time consuming and difficult to perform. Accordingly, it may be desirable to provide a more efficient and easier way to assemble and disassemble a torque track system.

BRIEF DESCRIPTION

Present embodiments are designed to respond to such a need. In accordance with one aspect of the invention, a top drive torque track system for a drilling rig includes a first elongate track including a male end. The male end includes a pin housing and a movable locking pin that is capable of being biased by a biasing member to extend out of the pin housing and to extend laterally from the male end. The top drive torque track system also includes a second elongate track having a female end configured to mate with the male end. The female end includes a locking socket extending laterally within the female end. The locking socket is configured to receive the movable locking pin. The movable locking pin is configured to engage the locking socket to attach the first elongate track to the second elongate track when the male end of the first elongate track is inserted into the female end of the second elongate track. The first and second elongate tracks are configured to engage with a top drive to facilitate transport of the top drive Present embodiments also provide a method for coordinating a top drive torque track system for a drilling rig. In one embodiment, the method includes coupling a male end of a first elongate track to a female end of a second elongate track. The female end of the second elongate track includes a hook and the male end of the first elongate track includes a fixed pin extending laterally from a pin housing of the male end. Coupling the male end of the first elongate track to the female end of the second elongate track includes coupling the hook of the female end with the fixed pin of the male end. The method also includes lifting the first elongate track using the hook of the female end of the second elongate track. The method includes positioning a movable locking pin extending laterally from the pin housing of the male end of the first elongate track to engage with a locking socket within the female end of the second track and to lock the first elongate track and the second elongate track together. The movable locking pin is biased by a biasing member.

In accordance with another aspect of the invention, an elongate torque track for a top drive torque track system for a drilling rig includes a male end having a pin housing and a movable locking pin that is capable of being biased by a biasing member to extend out of the pin housing and to extend laterally from the male end. The elongate torque track also includes a female end having a locking socket extending laterally within the female end. The locking socket is configured to receive a locking pin of a second elongate torque track to attach the elongate torque track to the second elongate torque track when the locking pin of the second elongate torque track is engaged with the female end of the elongate torque track. The movable locking pin is configured to engage a socket of a second elongate torque track to attach the elongate torque track to the second elongate torque track when the movable locking pin of the elongate torque track is engaged with the socket of the second elongate torque track.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present disclosure provides a novel top drive torque track system and methods for coordinating the top drive torque track system. As used herein, the term "coordinating" may refer to assembling, disassembling, or both. The presently disclosed techniques allow for elongate torque tracks to be coupled together without using separate or external pins to hold the elongate torque tracks together. As such, in one embodiment, a movable locking pin extends laterally out of one elongate torque track and is secured into a locking socket of an adjacent elongate torque track. The movable locking pin is essentially integral with an elongate torque track and designed to engage the locking socket of another torque track such that it locks the elongate torque tracks together when the elongate torque tracks are properly aligned. Further, the movable locking pin may be disengaged from the locking socket solely by moving the elongate torque tracks to different positions, as will be discussed in more detail below.

Figure 1:
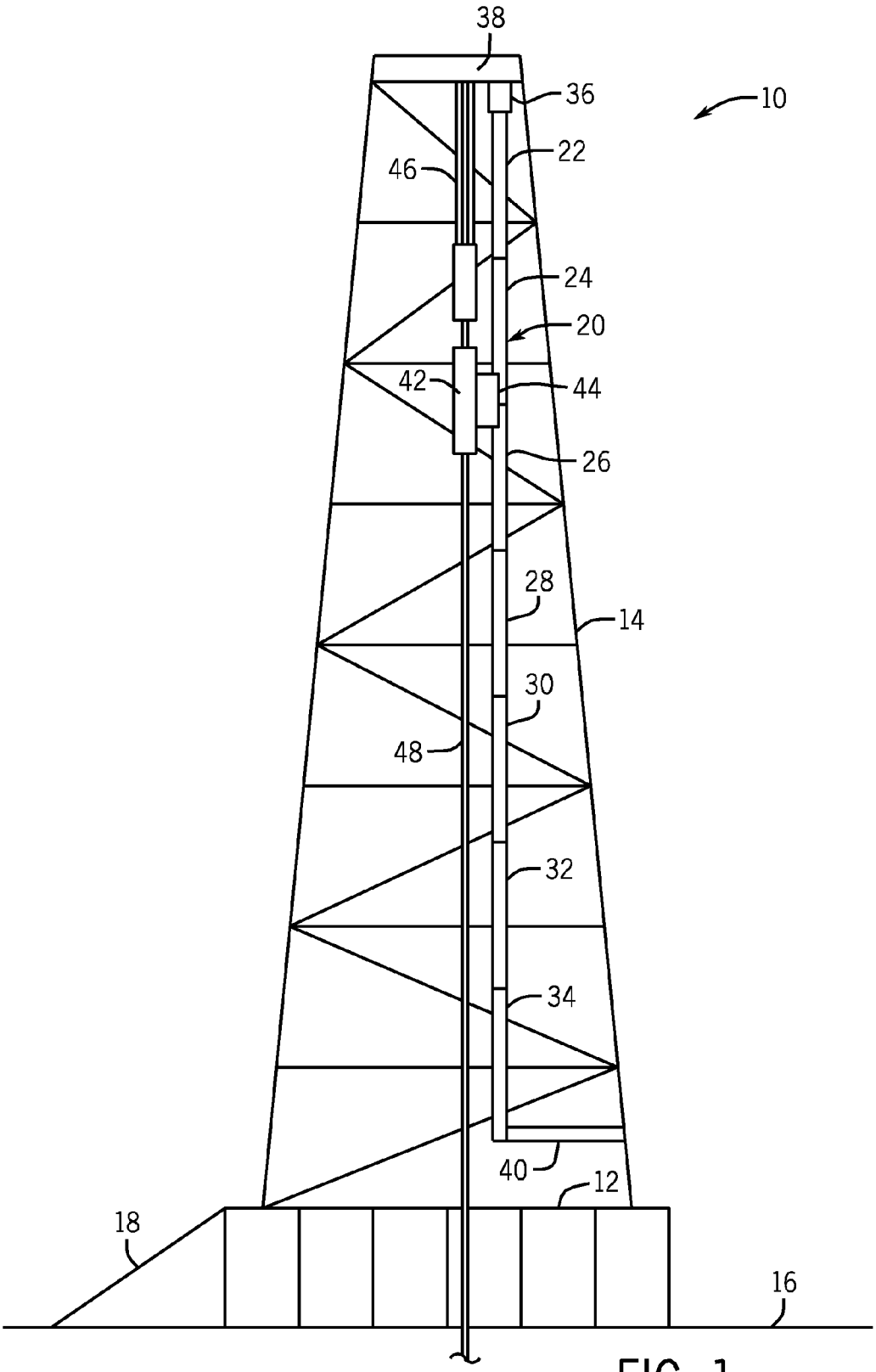
FIG. 1 is a schematic of a drilling rig in accordance with present techniques.

Turning now to the drawings, FIG. 1 is a schematic of a drilling rig 10 in the process of drilling a well. The drilling rig 10 features an elevated rig floor 12 and a derrick 14 extending above the rig floor 12. The elevated rig floor 12 is positioned above ground 16. As illustrated, a pipe ramp 18 extends from the ground 16 to the elevated rig floor 12 and may be used to aid in moving pipe from the ground 16 to the rig floor 12. A torque track system 20 extends from a bottom portion of the derrick 14 to a top portion of the derrick 14. The torque track system 20 is used to transfer torsional loads from a drilling operation to the derrick 14. The torque track system 20 includes multiple elongate torque tracks 22, 24, 26, 28, 30, 32, and 34. In certain embodiments, one or more of the elongate torque tracks includes a male end on one distal end and a female end on the opposite distal end. As will be appreciated, the torque track system 20 may include any number of elongate torque tracks, and such tracks may vary in length in relation to each other. Further, it should be noted that the derrick 14 may vary in height resulting in torque track systems 20 that vary in length.

To attach the torque track system 20 to the derrick 14, an adjustable hanging cluster 36 is coupled to the elongate torque track 22. The hanging cluster 36 is attached to a crown beam 38 (e.g., using a pad eye welded to the crown beam 38). The elongate torque track 34 at the bottom of the derrick 14 (i.e., the deflector section) is secured to the derrick 14 by fastening the torque track 34 to a T-bar 40. The T-bar 40 is fastened directly to the derrick 14 (e.g., such as by fastening the T-bar 40 to a torque anchor beam located at the bottom portion of the derrick 14). As will be appreciated, in other embodiments, the torque track system 20 may be coupled to the derrick 14 in other ways.

A top drive 42 is coupled to the torque track system 20 by a carriage assembly 44, which may be considered a component of the top drive 42. The carriage assembly 44 guides the top drive 42 along the torque track system 20 as the top drive 42 moves between the bottom and the top of the derrick 14. As will be appreciated, the torque track system 20 restrains the top drive 42 from lateral movement. The top drive 42 is suspended by a cable arrangement 46 which may be looped around the crown beam 38, or otherwise attached to the crown beam 38. Further, a drill string 48 is coupled to the top drive 42. The top drive 42 is used to rotate, raise, and lower the drill string 48, among other things. The drill string 48 passes through the elevated rig floor 12 into the ground 16 (e.g., into a wellbore).

It should be noted that the illustration of FIG. 1 is intentionally simplified to focus on the torque track system 20 described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
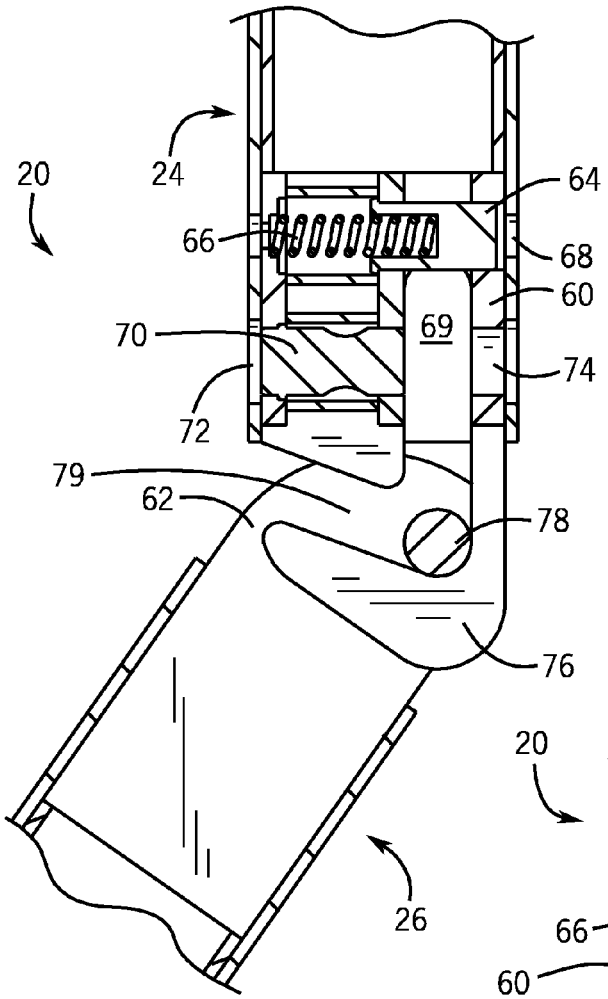
FIG. 2 is a cross-sectional view of an embodiment of a female end of an elongate torque track in a first stage of being coupled to an embodiment of a male end of an elongate torque track in accordance with present techniques.
Figure 3:
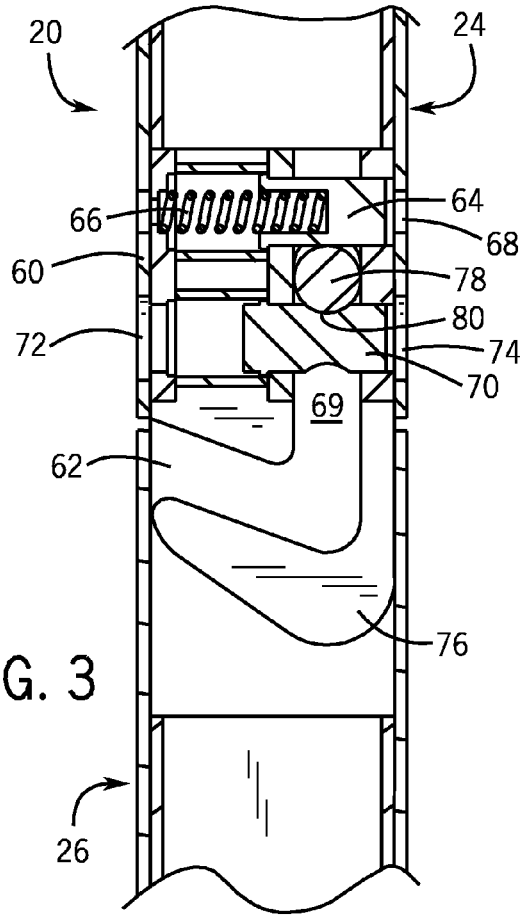
FIG. 3 is a cross-sectional view of the male and female embodiments of FIG. 2 in a second stage of being coupled together in accordance with present techniques.
Figure 4:
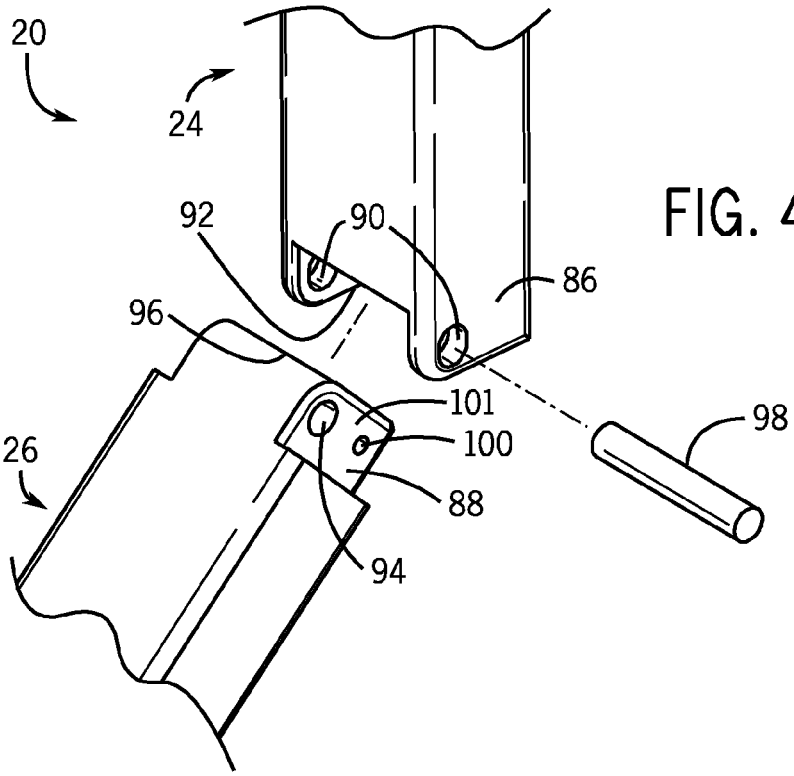
FIG. 4 is a perspective view of an embodiment of a female end of an elongate torque track in a first stage of being coupled to an embodiment of a male end of an elongate torque track in accordance with present techniques.
Figure 5:
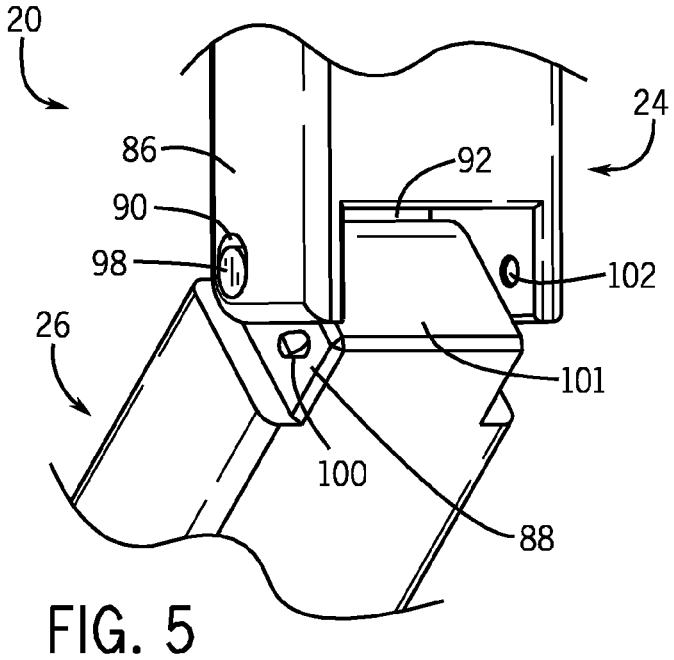
FIG. 5 is a perspective view of the male and female embodiments of FIG. 4 in a second stage of being coupled together in accordance with present techniques.
Figure 6:
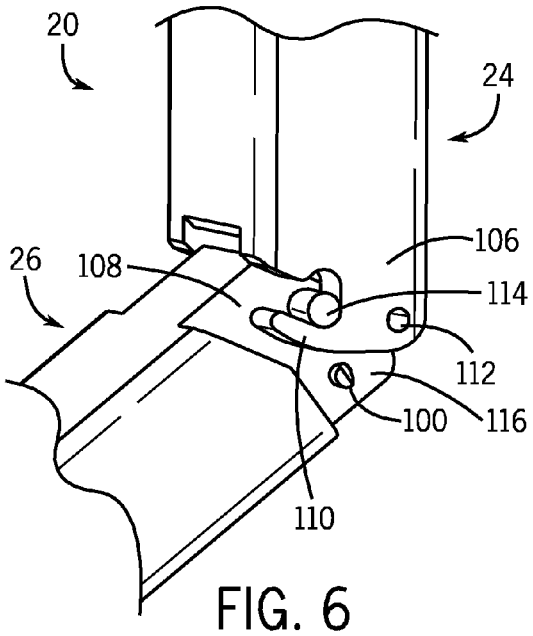
FIG. 6 is a perspective view of an embodiment of a female end of an elongate torque track in a first stage of being coupled to an embodiment of a male end of an elongate torque track in accordance with present techniques.
Figure 7:
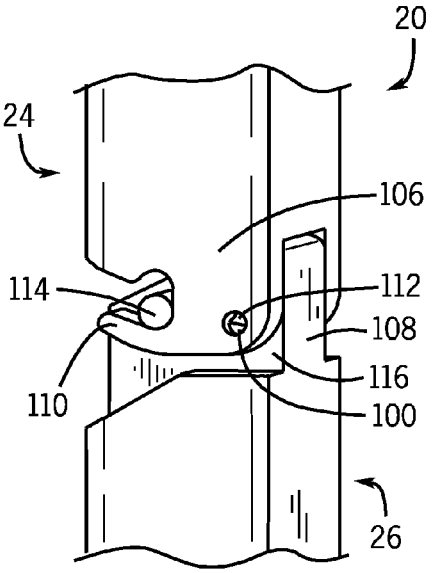
FIG. 7 is a perspective view of the male and female embodiments of FIG. 6 in a second stage of being coupled together in accordance with present techniques.

According to the techniques described below, the torque track system 20 may be assembled and disassembled in an efficient manner, and in certain embodiments, without insertion of a separate or external pin by a technician, or the like. For example, FIGS. 2 and 3 illustrate an embodiment of the torque track system 20 that uses integral or internal pins that are driven to different positions by a technician. As another example, FIGS. 4 and 5 illustrate an embodiment of the torque track system 20 that uses a movable locking pin in conjunction with an external pin that is inserted by a technician, wherein the movable locking pin is integral with a torque track and biased toward a position. FIGS. 6 and 7 illustrate an embodiment of the torque track system 20 that includes a hook assembly and a movable locking pin, without external pins that are inserted by a technician or internal pins that are driven by a technician.

FIG. 2 is a cross-sectional view of an embodiment of a female end 60 of the elongate torque track 24 in a first stage of being coupled to an embodiment of a male end 62 of the elongate torque track 26. The female end 60 includes a top internal pin 64 which includes a spring 66 that applies a biasing force to direct the top internal pin 64 toward an opening 68 in the female end 60. The spring 66 may be compressed by applying a force through the opening 68 to press the top internal pin 64 against the spring 66. In the illustrated embodiment, the spring 66 is extended such that the top internal pin 64 extends into a vertical channel 69. As will be appreciated, during assembly the top internal pin 64 may be pressed sufficiently toward the spring 66 so that it does not extend into or block the vertical channel 69. The female end 60 also includes a bottom internal pin 70 which may be alternately positioned by applying a force through opening 72 or through opening 74 in the female end 60. Applying a force to the bottom internal pin 70 through the opening 72 will direct the bottom internal pin 70 into the vertical channel 69 and toward the opening 74 (e.g., the bottom internal pin 70 in FIG. 3). Conversely, applying a force to the bottom internal pin 70 through the opening 74 will direct the bottom internal pin 70 away from the vertical channel 69 and toward the opening 72 (e.g., the bottom internal pin 70 illustrated in FIG. 2). The female end 60 includes a hook 76 which is used to capture a fixed pin 78 that extends laterally through a pin housing 79 of the male end 62.

In certain embodiments, the elongate torque track 24 may be attached to the elongate torque track 26 as follows. The hook 76 of the female end 60 of the torque track 24 captures the fixed pin 78 of the male end 62 of the torque track 26. The torque track 24 is raised and, when sufficiently raised, the captured torque track 26 will be in a generally vertical position and aligned with the torque track 24. After the torque track 26 is in the vertical position, a technician applies a force through the opening 68 to the top internal pin 64 (e.g., using an external drive bar) to move the pin 64 out of the vertical channel 69. In certain embodiments, the technician may need to maintain a force on the top internal pin 64 to keep the pin 64 out of the vertical channel 69. In other embodiments, the internal pin 64 may include a locking feature to keep the pin 64 out of the vertical channel 69 without maintaining force against the internal pin 64. The female end 60 of the torque track 24 is lowered around the male end 62 of the torque track 26. This causes the fixed pin 78 of the male end 62 to move through the vertical channel 69. After the fixed pin 78 passes the bottom internal pin 70, the technician applies a force through the opening 72 to the bottom internal pin 70 to cause the bottom internal pin 70 to move into the vertical channel 69 toward the opening 74. This causes the bottom internal pin 70 to block the vertical channel 69 and to keep the fixed pin 78 from exiting the vertical channel 69. The fixed pin 78 is then lowered to rest on the bottom internal pin 70. The technician releases the force from the top internal pin 64 to allow the spring 66 to force the top internal pin 64 toward the opening 68 and capture the fixed pin 78 between the top internal pin 64 and the bottom internal pin 70, as shown in FIG. 3. As illustrated, the fixed pin 78 rests in a recess 80 of the bottom internal pin 70. Accordingly, the torque track 24 is coupled to the torque track 26. As will be appreciated, the torque track 24 may be disconnected from the torque track 26 by performing the functions listed above in a reverse order.

As described in relation to FIGS. 2 and 3, the torque track system 20 may be assembled and disassembled without the use of external pins. As will be appreciated, using the techniques described above, the torque track system 20 may be assembled and disassembled more efficiently than torque track systems using multiple external pins or series of fasteners to hold sections of the torque track system 20 together.

FIG. 4 is a perspective view of an embodiment of a female end 86 of the elongate torque track 24 in a first stage of being coupled to an embodiment of a male end 88 of the elongate torque track 26. The female end 86 includes an opening 90 extending laterally through the female end 86, which may be described as openings 90 through the sides of the female end 86. The female end 86 also includes a recess 92 for receiving the male end 88 at an angle. Further, the male end 88 includes an opening 94 extending laterally through the male end 88. The male end 88 also includes a rounded edge 96 to facilitate rotation of the male end 88 after it is inserted into the recess 92 of the female end 86. The openings 90 and 94 allow a loose pin 98 to be driven therein to hold the male end 88 and the female end 86 together. As illustrated, the male end 88 also includes movable locking pins 100 extending laterally out of opposing sides of a pin housing 101 of the male end 88 (only one side is shown). The movable locking pins 100 are configured to engage locking sockets 102 (illustrated in FIG. 5) to attach the torque tracks 24 and 26 together.

To attach the elongate torque track 24 to the elongate torque track 26, the male end 88 of the torque track 26 is inserted into the recess 92 of the female end 86 of the torque track 24. Specifically, the male end 88 may be inserted into the recess 92 at an angle so that the rounded edge 96 is inserted into the recess 92 while the movable locking pins 100 are not yet inserted into the recess 92. The openings 90 and 94 are aligned and a technician drives the pin 98 through the openings 90 and 94 to hold one side of the male end 88 and the female end 86 together. FIG. 5 illustrates a perspective view of the embodiment of FIG. 4 assembled as just described. At this point during assembly, the movable locking pins 100 may be engaged with the locking sockets 102 that extend laterally within the female end 86. The movable locking pins 100 may be biased outward by a biasing member. Again, only one locking socket 102 is visible, but the female end 86 may include a locking socket 102 on the opposite side from the locking socket 102 shown. The movable locking pins 100 are engaged with the locking sockets 102 by rotating the torque track 26 to be substantially aligned with the torque track 24 (e.g., in a vertical position). In particular, the movable locking pins 100 are formed with a tapered upper side so that the movable locking pins 100 will be pressed inward against the bias and toward the pin housing 101 when the movable locking pins 100 make contact with the female end 86. When the movable locking pins 100 are aligned with the locking sockets 102, the movable locking pins 100 will re-extend outward from the pin housing 101 into the locking sockets 102 and secure the torque track 24 to the torque track 26.

As will be discussed in more detail below, in relation to FIG. 8, the movable locking pins 100 are configured to alternate between an extended position and a retracted position. For example, when the movable locking pins 100 are pressed toward the pin housing 101 a first time, the movable locking pins 100 are configured to return to the extended position when an external force is no longer applied to them. Conversely, when the movable locking pins 100 are pressed toward the pin housing 101 a second time, the movable locking pins 100 are configured to stay retracted within the pin housing 101 when an external force is no longer applied to them. Accordingly, to disassemble the torque track 24 from the torque track 26, the male end 88 is rotated toward the female end 86 (the torque tracks 24 and 26 rotate relative to each other using the pivot point created by the pin 98). This rotation causes the movable locking pins 100 to press against the edges of the locking sockets 102 and forces the movable locking pins 100 toward the pin housing 101 where the movable locking pins 100 stay retracted within the pin housing 101 when external force is no longer applied. Thus, the male end 88 may thereafter be rotated away from the female end 86 to return the torque tracks 24 and 26 to the position illustrated in FIG. 5. As will be appreciated, to disconnect the torque tracks 24 and 26, a technician may drive the pin 98 out of the openings 90 and 94 to remove the pin 98 from the openings 90 and 94.

FIG. 6 is a perspective view of an embodiment of a female end 106 of the elongate torque track 24 in a first stage of being coupled to an embodiment of a male end 108 of the elongate torque track 26. The female end 106 of the torque track 24 includes a hook 110 that may be used for lifting other tracks and for holding tracks together, for example. The female end 106 also includes locking sockets 112 (only one side is shown) which extend laterally within the female end 106 and are configured to receive moveable locking pins 100. The male end 108 includes a fixed pin 114 that extends laterally out of a pin housing 116. The male end 108 also includes movable locking pins 100 configured to engage the locking sockets 112 to attach the torque tracks 24 and 26 together.

To attach the elongate torque track 24 to the elongate torque track 26, the hook of the female end 106 of the torque track 24 captures the fixed pin 114 of the male end 108 of the torque track 26, as illustrated in FIG. 6. The torque track 24 may be lifted, thereby raising the torque track 26 into a generally vertical position, as illustrated in FIG. 7. As the torque track 26 is raised, the movable locking pins 100 rotate toward the locking sockets 112. The movable locking pins 100 are engaged with the locking sockets 112 by positioning the torque track 26 to be substantially aligned with the torque track 24 (e.g., in a vertical position). As previously discussed, the movable locking pins 100 are formed with a tapered upper side so that the movable locking pins 100 will be pressed inward toward the pin housing 116 when the movable locking pins 100 make contact with the female end 106. When the movable locking pins 100 are aligned with the locking sockets 112, the movable locking pins 100 will re-extend out from the pin housing 116 into the locking sockets 112 to engage the locking sockets 112 and secure the torque track 24 to the torque track 26.

To disconnect the torque track 24 from the torque track 26, the side of the male end 108 with the movable locking pins 100 is rotated toward the female end 106. This rotation causes the movable locking pins 100 to press against the edges of the locking sockets 112 and forces the movable locking pins 100 inward toward the pin housing 116 where the movable locking pins 100 stay retracted within the pin housing 116 when external force is no longer applied. Thus, the male end 108 may thereafter be rotated away from the female end 106 to return the torque tracks 24 and 26 to the position illustrated in FIG. 6. As will be appreciated, to finish disconnecting the torque tracks 24 and 26, the torque track 26 may be lowered to the ground and the hook 110 disconnected from the fixed pin 114.

In such a configuration, the torque track system 20 may be efficiently assembled and disassembled. Further, a technician does not need to be physically located near the junctions of the torque tracks because the assembly and disassembly does not require a technician to insert, remove, or activate pins at the male and female ends of the torque tracks. Thus, time and money may be conserved by using such a torque track system 20.

Figure 8:
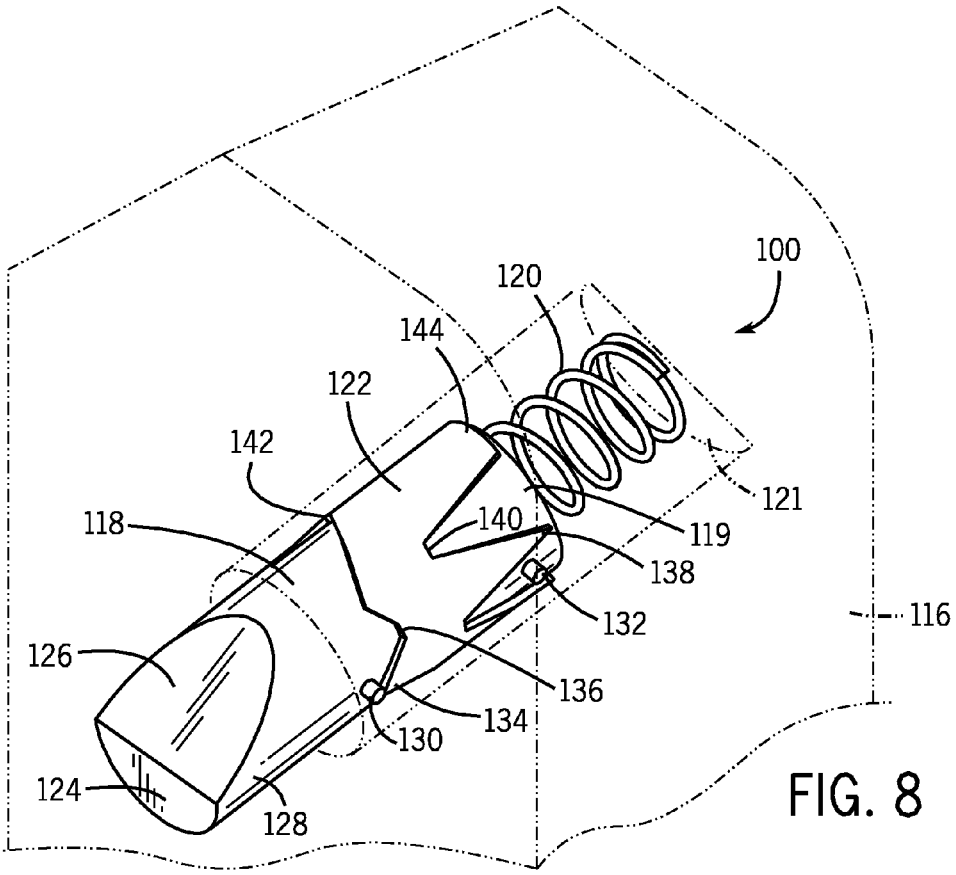
FIG. 8 is a perspective view of an embodiment of a movable locking pin in accordance with present techniques.

FIG. 8 is a perspective view of an embodiment of the movable locking pin 100. The movable locking pin 100 includes a body portion 118 with an internal end 119 that abuts a spring 120 which is representative of a biasing member. Further, the spring 120 abuts a cavity 121 in the pin housing 116. The body portion 118 of the locking pin 100 is surrounded by a slider 122. As will be appreciated, the spring 120 may be compressed by applying a force to an exposed end 124 of the locking pin 100. Depending on the position of the slider 122, the spring 120 may be decompressed by removing force from the exposed end 124 of the locking pin 100. The exposed end 124 includes a tapered top portion 126 and an untapered portion 128. The tapered portion 126 allows a vertical force to be applied to the locking pin 100 in order to press the body portion 118 of the pin toward the male end 108 and to compress the spring 120 (e.g., the female side of the torque tracks as discussed above may apply such a vertical force). Pin guides 130 and 132 extend out of the body portion 118 of the locking pin 100. As may be appreciated, the opposite side of the body portion 118 may include another set of pin guides 130 and 132. The pin guides 130 and 132 facilitate rotation of the slider 122 around the body portion 118 and determine whether the movable locking pin 100 will re-extend out of the pin housing 116 after being pressed, or whether the movable locking pin 100 will remain retracted inside the pin housing 116 after being pressed.

To facilitate alternations between re-extending and remaining refracted, the slider 122 includes a number of peaks and valleys. For example, the slider 122 includes peak 134 and valley 136 on the side of the slider 122 adjacent to the extension 130. When force is applied to press the body portion 118 toward the spring, the extension 130 applies a force on the slider 122 as it moves between the peak 134 and the valley 136. On the other end of the slider 122, the extension 132 moves toward the peak 138 and crosses the peak 138 as the extension 130 reaches the valley 136. Thus, when force is released from the exposed end 124, the spring 120 exerts a force on the body portion 118 to press the body portion 118 out from the pin housing 116. As this occurs, the extension 132 does not resist the spring 120 force, but instead moves along the peak 138 until it reaches a valley 140, thereby rotating the slider 122 to a new position.

When a force is again applied to the exposed end 124 of the body portion 118, the extension 130 is moved along the slider 122 toward a valley 142. Conversely, the extension 132 moves from the valley 140 to an elongated peak 144. When the extension 132 reaches the elongated peak 144, the extension 132 will lock the body portion 118 against the spring 120, even when force is removed from the exposed end 124 of the body portion 118 and the extension 132 rests against the elongated peak 144. Thus, the movable locking pin 100 will remain in this retracted position until it is reset. After being reset, the movable locking pin 100 will repeat the same sequence. In certain embodiments, the movable locking pin 100 may be reset by pressing the exposed end 124 further within the pin housing 116 until the locking pin 100 is reset. As will be appreciated, in certain embodiments, the slider 122 may include the same pattern of peaks and valley on the side not shown.

With such a movable locking pin 100, the locking pin 100 may be pressed a first time and re-extend when released. However, when pressed a second time, the movable locking pin 100 will remain retracted within the pin housing 116. Therefore, such a movable locking pin 100 may be used in the torque track sections to facilitate assembly and disassembly without a technician accessing the junctions of the torque track sections. As such, the torque track system 20 may be assembled and disassembled efficiently.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A top drive torque track system for a drilling rig comprising:

a first elongate track including a male end, the male end comprising a pin housing and a movable locking pin that is capable of being biased by a biasing member to extend out of the pin housing and to extend laterally from the male end; and a second elongate track having a female end configured to mate with the male end, the female end comprising a locking socket extending laterally within the female end, the locking socket configured to receive the movable locking pin, wherein the movable locking pin is configured to engage the locking socket to attach the first elongate track to the second elongate track when the male end of the first elongate track is inserted into the female end of the second elongate track, the first and second elongate tracks are configured to engage with a top drive to facilitate transport of the top drive, and the female end of the second elongate track comprises a hook configured to lift the first track via coupling with a fixed pin extending laterally from the pin housing of the male end of the first elongate track.

2. The top drive torque track system of claim 1, wherein the male end of the first elongate track comprises a second movable locking pin extending laterally from the male end on a side of the male end opposite the movable locking pin and the female end of the second elongate track comprises a second locking socket extending laterally within the female end and configured to receive the second movable locking pin.

3. The top drive torque track system of claim 1, wherein the male end of the first elongate track comprises the fixed pin extending latterly from the pin housing adjacent to the movable locking pin, wherein the fixed pin is configured to be captured by the hook of the female end.

4. The top drive torque track system of claim 1, wherein the male end of the first elongate track comprises a first lateral opening extending through the male end and the female end of the second elongate track comprises a second lateral opening extending through the female end, the first and second lateral openings configured to allow a loose pin to be inserted through the lateral openings to attach the male and female ends together.

5. The top drive torque track system of claim 1, wherein the movable locking pin comprises a biasing member configured to selectively bias the movable locking pin to extend out of the pin housing to enable engagement of the movable locking pin with the locking socket, or to retract within the pin housing to enable disengagement of the movable locking pin with the locking socket.

6. The top drive torque track system of claim 5, wherein the movable locking pin comprises a pin portion having a first end adjacent to the biasing member and a second end opposite the first end, the second end comprising a tapered top side configured to cause the locking pin to be pressed toward the pin housing of the male end of the first elongate track when the male end is inserted into the female end.

7. The top drive torque track system of claim 5, wherein the movable locking pin is configured to extend out of the pin housing to enable engagement of the movable locking pin with the locking socket when the movable locking pin is pressed toward the pin housing a first time, and to retract within the pin housing to enable disengagement of the movable locking pin with the locking socket when the movable locking pin is pressed toward the pin housing a second time.

8. A method for coordinating a top drive torque track system for a drilling rig comprising:

coupling a male end of a first elongate track to a female end of a second elongate track, the female end of the second elongate track comprising a hook and the male end of the first elongate track comprising a fixed pin extending laterally from a pin housing of the male end, wherein coupling the male end of the first elongate track to the female end of the second elongate track comprises coupling the hook of the female end with the fixed pin of the male end;

lifting the first elongate track using the hook of the female end of the second elongate track; and positioning a movable locking pin extending laterally from the pin housing of the male end of the first elongate track to engage with a locking socket within the female end of the second track and to lock the first elongate track and the second elongate track together, wherein the movable locking pin is biased by a biasing member.

9. The method of claim 8, comprising moving the female end of the second elongate track toward the male end of the first elongate track to disengage the movable locking pin of the male end of the first elongate track from the locking socket within the female end of the second track.

10. The method of claim 9, comprising moving the female end of the second elongate track off of the male end of the first elongate track.

11. The method of claim 10, comprising resetting the movable locking pin by pressing the movable locking pin into the pin housing of the male end of the first elongate track and releasing the movable locking pin to cause the movable locking pin to extend out of the pin housing of the male end of the first elongate track.

12. The method of claim 8, comprising positioning a second movable locking pin extending laterally from the pin housing of the male end of the first elongate track to engage with a second locking socket within the female end of the second track, wherein the second movable locking pin is biased by the biasing member or another biasing member.

13. An elongate torque track for a top drive torque track system for a drilling rig comprising:

a male end comprising a pin housing and a movable locking pin;

a body portion of the movable locking pin;

a biasing member of the movable locking pin configured to bias the body portion to extend laterally out of the pin housing; and a slider of the movable locking pin configured to rotate about a body pin axis and interact with pin guides of the body portion to guide extension and retraction of the body portion such that rotation of the slider enables the biasing member to drive the body portion out of the pin housing to an extended position after the locking pin is pressed toward the housing a first time and to enable retraction of the body portion into the pin housing to a retracted position after the locking pin is pressed toward the housing a second time;

a female end comprising a locking socket extending laterally within the female end, the locking socket configured to receive a locking pin of a second elongate torque track to attach the elongate torque track to the second elongate torque track when the locking pin of the second elongate torque track is engaged with the female end of the elongate torque track, wherein the movable locking pin is configured to engage a socket of the second elongate torque track to attach the elongate torque track to the second elongate torque track when the movable locking pin of the elongate torque track is engaged with the socket of the second elongate torque track.

14. The elongate torque track of claim 13, wherein the female end of the elongate track comprises a hook for lifting the second elongate torque track via coupling with a rigid pin extending laterally from the second elongate torque track.

15. The elongate torque track of claim 14, wherein the male end of the elongate torque track comprises a fixed pin extending latterly from the pin housing adjacent to the movable locking pin, wherein the fixed pin is configured to be captured by a second elongate torque track hook.

16. The elongate torque track of claim 13, wherein the movable locking pin comprises the biasing member configured to selectively bias the movable locking pin to extend out of the pin housing to enable engagement of the movable locking pin with the second elongate torque track socket, or to retract within the pin housing to enable disengagement of the movable locking pin with the second elongate torque track socket.

17. The elongate torque track of claim 16, wherein the movable locking pin comprises a pin portion having a first end adjacent to the biasing member and a second end opposite the first end, the second end comprising a tapered top side configured to cause the movable locking pin to be pressed toward the pin housing of the male end of the elongate torque track when the movable locking pin is engaged with the second elongate torque track socket.

18. The elongate torque track of claim 16, wherein the movable locking pin is configured to extend out of the pin housing to enable engagement of the movable locking pin with the second elongate torque track socket when the movable locking pin is pressed toward the pin housing a first time, and to retract within the pin housing to enable disengagement of the movable locking pin with the second elongate torque track socket when the movable locking pin is pressed toward the pin housing a second time.

19. The elongate torque track of claim 13, wherein the male end of the elongate torque track comprises a first lateral opening extending through the male end and the female end of the elongate torque track comprises a second lateral opening extending through the female end, the first and second lateral openings configured to allow a loose pin to be inserted through the first and second lateral openings to attach the male end to the second elongate torque track and the female end to the second elongate torque track.

* * * * *